US005770987A

United States Patent [19]

Henderson

[11] Patent Number: 5,770,987

[45] Date of Patent: Jun. 23, 1998

[54] COPLANAR WAVEGUIDE STRIP BAND PASS FILTER

[76] Inventor: Bert C. Henderson, 915 Lois Ave., Sunnyvale, Calif. 94087

[21] Appl. No.: 709,274

[22] Filed: Sep. 6, 1996

[51] Int. Cl.[6] ..... H01P 1/203; H01P 3/08

[52] U.S. Cl. ..... 333/204; 333/219

[58] Field of Search ..... 333/204, 205, 333/219, 236, 246

[56] References Cited

U.S. PATENT DOCUMENTS

| | | | |
|---|---|---|---|
| 3,605,045 | 9/1971 | Ramsbotham, Jr. | 333/204 |
| 3,805,198 | 4/1974 | Gewartowski et al. | 333/204 |
| 4,313,095 | 1/1982 | Jean-Frederic | 333/116 |
| 4,455,540 | 6/1984 | Henriot et al. | 333/205 |
| 4,975,664 | 12/1990 | Ito et al. | 333/205 |
| 5,461,352 | 10/1995 | Noguchi et al. | 333/204 |
| 5,485,131 | 1/1996 | Fajen et al. | 333/202 |

FOREIGN PATENT DOCUMENTS

| | | | |
|---|---|---|---|
| 1406670 | 6/1988 | U.S.S.R. | 333/204 |
| 2153155 | 8/1985 | United Kingdom | 333/204 |

OTHER PUBLICATIONS

Lin et al., "Coplanar Waveguide Bandpass Filter–A Ribbon–of–Brick–Wall Design", IEEE Tran. On Microwave Theory & Tech. vol. 43, No. 7, Jul. 1995, pp. 1589–1596.

*Primary Examiner*—Robert Pascal
*Assistant Examiner*—Seungsook Ham
*Attorney, Agent, or Firm*—Steven J. Adamson; Edward B. Anderson

[57] ABSTRACT

A coplanar band pass filter having a centerline formed of at least first and second serially arranged conducting segments which are separated by a gap. The centered segments are flanked by a resonator for coupling return current from the first and second segments. Conducting members that may include conductive strips or conductive planes are respectively provided on opposing sides of the resonator and centerline. Band pass elements may be provided in the conductive strips or planes to reduce or eliminate spurious pass band frequencies.

21 Claims, 1 Drawing Sheet

Fig. 1
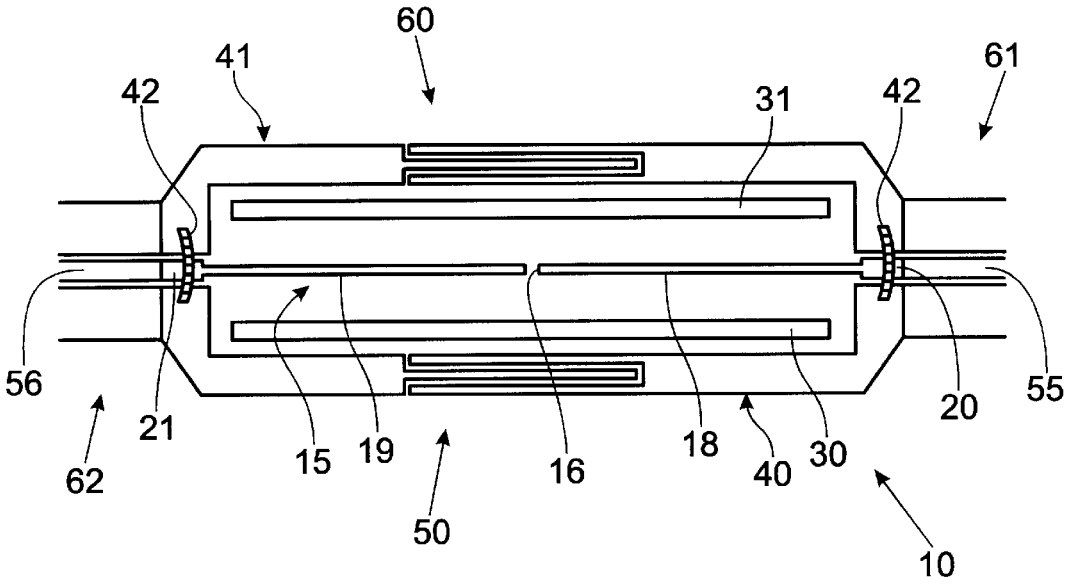
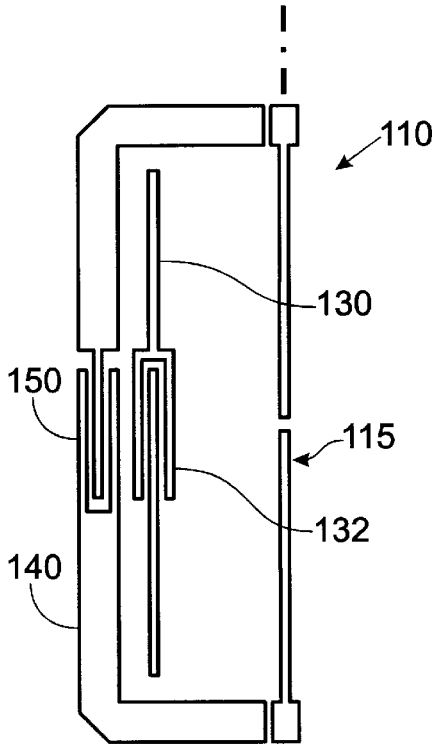
Fig. 2
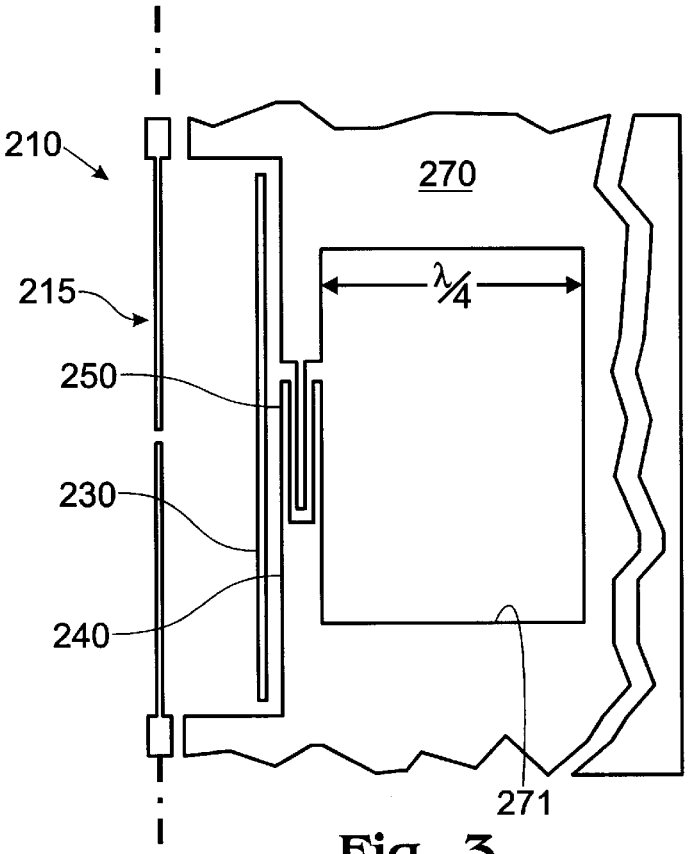
Fig. 3

COPLANAR WAVEGUIDE STRIP BAND PASS FILTER

FIELD OF THE INVENTION

The present invention relates to band pass filters and, more specifically, to reducing spurious pass band frequencies and other deleterious effects in such filters.

BACKGROUND OF THE INVENTION

For use in microwave integrated circuits (MIC) and monolithic microwave integrated circuits (MMIC), band pass filters such as the Ribbon-of-Brick-Wall (RBW) filter described in Coplanar Waveguide Bandpass Filter — A Ribbon-of-Brick-Wall Design, by Lin et al., IEEE, 1995, have been proposed.

The RBW coplanar waveguide (CPW) filter comprises a centerline surrounded by two ground planes in which a portion of the centerline is configured to have a quarter wavelength open ended stub conductor flanked by quarter wavelength open-ended stub resonators.

The RBW CPW filter of Lin et al. represents an improvement over prior art microstrip filters with respect to ease of series and shunt connections, absence of via holes, insensitivity to substrate thickness, and low dispersive effects. Notwithstanding these improvements however, the design of Lin et al. is disadvantageous in that it may permit spurious pass bands and may suffer from moding which results in significant reductions in gain at frequencies corresponding to quarter wavelength multiples of the ground plane length.

In addition, conventional coplanar devices have expansive ground planes which take up a disadvantageously large amount of substrate area.

SUMMARY OF THE INVENTION

Accordingly, it is an object of the present invention to provide a coplanar band pass filter having a compact design.

It is another object of the present invention to provide a coplanar band pass filter that reduces or eliminates spurious pass band frequencies.

It is another object of the present invention to achieve a compact design and eliminate moding in a band pass filter by configuring that filter in coplanar strip format.

It is another object of the present invention to achieve reduction or elimination of spurious pass band frequencies by providing a band pass element in such coplanar strips.

And it is yet another object of the present invention to provide enhanced band pass filtering in a band pass filter having a conventional conducting plane.

These and related objects of the present invention are achieved by use of the coplanar band pass filter herein described.

In one embodiment of the present invention, a coplanar band pass filter is provided that is configured in CPW strip so as to provide a more compact design, reduce requisite materials and eliminate moding.

In another embodiment of the present invention, a coplanar band pass filter is provided that includes band pass elements in signal return conducting members. The conducting members may be either CPW strips or conventional planes. The width of a strip is preferably a quarter wavelength of a frequency greater than a design frequency of the filter. The band pass elements are preferably capacitors, and further, distributed capacitors.

The filter comprises an interrupted center conductor flanked by at least one resonator. A band pass element may be provided in the resonator.

The attainment of the foregoing and related advantages and features of the invention should be more readily apparent to those skilled in the art, after review of the following more detailed description of the invention taken together with the drawings.

BRIEF DESCRIPTION OF THE DRAWINGS

FIG. 1 is a diagram of a coplanar band pass filter in accordance with the present invention.

FIG. 2 is a diagram of a portion of a coplanar band pass filter having a band pass element within a resonator in accordance with the present invention.

FIG. 3 is a diagram of a portion of a coplanar band pass filter configured in conventional CPW in accordance with the present invention.

DETAILED DESCRIPTION

The present invention may be implemented in microwave integrated circuits (MIC), monolithic microwave integrated circuits (MMIC), and multi-chip modules (MCM) or multi-chip integrated circuits (MCIC). It is well suited for microwave and millimeter wave applications, and is directly scalable to other frequencies.

Referring to FIG. 1, a diagram of a coplanar waveguide (CPW) band pass filter 10 is accordance with the present invention is shown.

The filter 10 includes a centered printed trace referred to herein as a centerline 15 which is separated by gap 16 into first 18 and second 19 segments. The first segment 18 narrows from a base 20 at which it is connected to a centerline 55 of an input coplanar waveguide (CPW) transmission line 61. The second segment 19 similarly narrows from base 21 at which it is coupled to a centerline 56 of an output CPW transmission line 62. The first and second segments are preferably approximately a quarter of a design wavelength in length. Their width and the length of gap 16 may be dependent on photolithographic tolerances. The narrowing of segments 18,19 from their connection to the CPW transmission media to gap 16 provides a desired up transformation of impedance. For other applications, segments 18,19 could be configured such that they maintain their shape or expand, thus providing no impedance transformation or a downward transformation, respectively.

The centerline 15 is flanked by a pair of resonators 30,31 which are preferably centered about gap 16. Each resonator is preferably approximately one-half of a design wavelength in length.

A conducting member 40 is provided adjacent to and generally in a spaced parallel relationship with resonator 30, on the side opposite that of centerline 15, while a conducting member 41 is provided adjacent to and preferably in a spaced parallel relationship with resonator 31, on the side opposite that of centerline 15. The conducting members 40,41 are connected to and form part of the conductive strips of the CPW strip transmission lines 61,62. Bond wires 42 electrically interconnect the conducting members 40,41. It should be recognized that the use of conductive strips as opposed to a conventional conducting plane provides a more compact design, requires less material and eliminates moding. The conducting members 40,41 and the strips to which they connect preferably have a width of a quarter wavelength of a frequency greater than a design frequency of the filter. The spacing of the resonators from both segments 18,19 and conducting members 40,41 provides a ratio of capacitive values that defines a bandwidth of the filter.

Each conducting member 40,41 includes a band pass element 50,60 for more precisely tuning the frequency response of band pass filter 10. The band pass elements 50,60 are preferably positioned in a region of the conducting member centered about gap 16 (i.e., they are provided where resonators 30,31 are coupling current from first segment 18 to second segment 19). Additionally, the band pass elements 50,60 are preferably configured as capacitors and thus are theoretically high pass elements which reject spurious frequencies below a desired pass frequency. Parasitic inductance associated with capacitive elements, however, also provides rejection of bands above a desired pass band, thereby effectively making the capacitors band pass elements.

The embodiment of FIG. 1 illustrates the band pass elements implemented as distributed capacitors of three coupled lines. It should be recognized that other distributed capacitor configurations may be used such as two coupled lines, interdigitated, angled-rectilinear and non-rectilinear patterns and the like. Design criteria for creating a suitable configuration include providing a desired amount of capacitance in a minimal amount of substrate area.

It should also be recognized that other capacitive devices could be used for implementing a band pass element 50,60 and these include chip mounted parallel plate and reverse diode configurations and the like. Planar patterned band pass elements may be preferred, however, since they do not require additional device mounting steps.

The components of filter 10 recited above are made of a suitable conductive material, such as gold (Au), and are formed on a substrate of suitable dielectric material, such as BeO, AlN, GaAs, etc.

Filter 10 and filters 110 and 210 described below are preferably designed using field solving software known in the art such as that provided by Zeland Software, Inc., of San Francisco, Calif.

A CPW strip configuration is utilized because conventional CPW ground planes can produce moding which results in significant reductions in gain at frequencies corresponding to quarter wavelength multiples of the ground plane length. The widths of the non-centerline conductive strips of CPW strip transmission lines 60,61 preferably correspond to quarter wavelengths of frequencies significantly above that of the filter's design frequency. For example, if filter 10 is designed to operate at 50 GHz, the strips are preferably designed to have widths that are a quarter wavelength of 150 GHz or more.

In operation, AC current in filter 10 propagates through input CPW centerline 55 into first segment 18. Gap 16 stops current flow in the centerline, thereby preventing further propagation of current other than that which is of a suitable frequency to couple to resonators 30,31.

Current coupled from segment 18 to resonators 30,31 propagates along resonators 30,31 from the region where it is coupled from first segment 18 to a region where it is coupled to segment 19. The current in resonators 30,31 also generates a corresponding current in conducting members 40,41, respectively. Current coupled to the second segment 19 propagates to output CPW centerline 56.

Computer field solver analysis and empirical evidence has indicated that reducing current density in the center of conducting members 40,41, eliminates spurious pass band frequencies. Current density reduction is achieved by use of band pass elements 50,60 which restrict the band of AC current which propagates along conducting members 40,41. Band pass elements 50,60 are preferably located in a region of conducting members 40,41 corresponding to the location of gap 16.

It should be noted that although the embodiment of FIG. 1 includes two centerline segments and two resonator elements, different centerline and resonator configurations are possible. The provision of band pass elements in the conductive members to reduce current density therein is the same regardless of the number or configuration of centerline and resonator components.

It should be further recognized that serial connection of two of the filters 10 of FIG. 1 achieves twice the out-of-band filter rejection, but at the expense of doubling in-band insertion loss.

Other Embodiments

Reducing current density in the conducting members at selected frequencies achieves a desired elimination of spurious frequency pass bands. Reducing this current density may be achieved by providing a band pass element in conductive members 40,41 as illustrated above. Conducting member current density can also be reduced by providing a band pass element in resonators 30,31 to thereby reduce current coupled to the conducting members.

Referring to FIG. 2, an diagram of a portion of a coplanar band pass filter 110 having a band pass element 132 in the resonator is shown. Approximately half of filter 110 is shown and that part which is not shown is symmetric about centerline 115 as in filter 10 of FIG. 1. The band pass element 132 is provided in resonator 130 to select the frequency band of current propagating along the resonator and the frequency band of current coupled to conducting member 140. Filter 110 can be realized with or without the band pass element 150.

Although a three coupled line distributed capacitor is shown for element 132, other configurations and band pass elements as discussed above may be used.

The filter embodiments disclosed in FIGS. 1–2 are configured in CPW strip. The present invention may also be configured in conventional CPW with characteristically expansive ground planes.

Referring to FIG. 3, an assembly diagram of a portion of a coplanar band pass filter 210 configured in conventional CPW in accordance with the present invention is shown. Approximately half of filter 210 is shown and the part that is not shown is symmetric about centerline 215 from that which is shown.

The filter 210 includes a conventional ground plane 270 that is illustrated with a wavy line border to indicate that the ground plane extends beyond the surface area allotted in FIG. 3. An opening 271 is created in ground plane 270 to define a conducting member 240. Opening 271 is approximately one quarter of a design wavelength or longer in a dimension perpendicular to centerline 215. Opening 271 serves to reduce or eliminate short circuit passage of spurious frequencies in the ground plane by effectively channelling current through conducting member 240 which contains a band pass element 250. The band of operation of filter 210 is more narrow than that of filter 10.

The band pass element 250 is configured in a manner analogous to band pass elements 50,60 of FIG. 1. Resonator 230 provides the same function as resonator 30 of FIG. 1.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

I claim:

1. A band pass filter, comprising:

a substrate;

a centerline formed on said substrate that comprises at least first and second serially arranged conducting segments separated from one another;

at least a first resonator formed on said substrate in a spaced relationship from said centerline for coupling current from said first segment and said second segments; and first and second signal return conducting strips formed on said substrate on opposite sides of said centerline and resonator, said first and second conducting strips being configured to reduce moding.

2. The filter of claim 1, further comprising:

first and second band pass elements respectively formed in said first and second signal return conducting strips.

3. The filter of claim 2, wherein said band pass elements include capacitors.

4. The filter of claim 3, wherein said capacitors include distributed capacitors.

5. The filter of claim 1, further comprising a second resonator formed on said substrate on a side of said centerline opposite that of said first resonator, said first and second resonators being respectively formed between said first and second signal return conducting strips.

6. The filter of claim 1, wherein said first conducting segment has a first end for coupling to a centerline of a CPW and a second end positioned adjacent said second conducting segment;

wherein the width of said first end is greater than that of said second end, to thereby achieve an impedance step.

7. The filter of claim 1, wherein said resonator includes a band pass element.

8. The filter of claim 1, wherein said first and second signal return conducting strips have a width of a quarter wavelength of a frequency greater than that of a design frequency of filter.

9. A coplanar bandpass filter, comprising:

a substrate;

a centerline formed on said substrate that comprises at least first and second serially arranged conducting segments separated from one another;

at least a first resonator formed on said substrate in a spaced relationship from said centerline for coupling current from said first and second segments;

at least a first signal return conducting member formed on said substrate proximate said first resonator; and a first band pass element provided in said first signal return conducting member.

10. The filter of claim 9, further comprising a second resonator formed on said substrate on a side of said centerline opposite that of said first resonator.

11. The filter of claim 10, further comprising a second signal return conducting member formed on said substrate proximate said second resonator, said first and second signal return conducting members being formed on opposite sides of said centerline outside of said resonators.

12. The filter of claim 11, wherein said second signal return conducting member includes a second band pass element.

13. The filter of claim 12, wherein said first and second band pass elements are capacitors.

14. The filter of claim 9, wherein said first resonator includes a band pass element.

15. The filter of claim 9, wherein said first signal return conducting member includes a conducting strip.

16. The filter of claim 9, wherein said first signal return conducting member includes a first portion of a conventional CPW conducting plane.

17. The filter of claim 16, wherein said first portion of a CPW plane is configured so as to define an opening therein that has a length dimension perpendicular to said centerline of at least one quarter of a design wavelength from the position of said first signal return conducting member containing said band pass element.

18. A coplanar band pass filter, comprising:

a substrate;

a centerline formed on said substrate that comprises at least first and second serially arranged conducting segments separated by a gap from one another;

first and second resonator elements formed on said substrate and respectively positioned on opposite sides of said centerline in a spaced substantially parallel manner for coupling current from said first and second segments;

first and second conductive strips formed on said substrate and respectively positioned on opposite sides of said centerline exterior of said resonators, said conductive strips being arranged in spaced, substantially parallel manner with said resonators; and first and second band pass elements respectively provided in said first and second conductive strips.

19. The filter of claim 18, wherein said band pass elements include capacitors.

20. The filter of claim 18, wherein said first and second conductive strips each have a width of a quarter wavelength of a frequency greater than a design frequency of said filter.

21. A band pass filter, comprising:

a substrate;

a centerline formed on said substrate that consists of first and second serially arranged conducting segments separated from one another and each having a length of approximately one-quarter wavelength of a design frequency;

at least a first resonator formed on said substrate in a spaced relationship from said centerline for coupling current from said first segment and said second segment, said first resonator having a length of approximately one-half wavelength of a design frequency; and first and second signal return conductors formed on said substrate on opposite sides of said centerline and resonator and configured to reduce moding.

* * * * *